US006736129B1

(12) United States Patent
Smith

(10) Patent No.: US 6,736,129 B1
(45) Date of Patent: May 18, 2004

(54) SUBMERGED COMBUSTION SNOW MELTING APPARATUS

(76) Inventor: David G. Smith, 9591 N. Bay Dr., Baileys Harbor, WI (US) 43202

( * ) Notice: Subject to any disclaimer, the term of this patent is extended or adjusted under 35 U.S.C. 154(b) by 44 days.

(21) Appl. No.: 10/093,574

(22) Filed: Mar. 8, 2002

Related U.S. Application Data

(60) Provisional application No. 60/350,495, filed on Nov. 13, 2001, and provisional application No. 60/275,054, filed on Mar. 12, 2001.

(51) Int. Cl.[7] ..... F24C 15/16; E01H 5/10

(52) U.S. Cl. ..... 126/343.5 R; 37/228

(58) Field of Search ..... 126/343.5 R, 343.5 A; 37/228, 227

(56) References Cited

U.S. PATENT DOCUMENTS

| | | | | |
|---|---|---|---|---|
| 2,159,759 A | | 5/1939 | Doennecke et al. | |
| 2,418,162 A | | 4/1947 | Cecil et al. | |
| 2,723,659 A | | 11/1955 | Young et al. | |
| 3,060,921 A | | 10/1962 | Luring et al. | |
| 3,368,548 A | | 2/1968 | Santoleri et al. | |
| 3,452,459 A | * | 7/1969 | Campion | 37/229 |
| 3,692,017 A | | 9/1972 | Glachant et al. | |
| 3,763,915 A | | 10/1973 | Perry et al. | |
| 3,818,893 A | | 6/1974 | Kataoka et al. | |
| 3,835,909 A | | 9/1974 | Douglas et al. | |
| 3,872,855 A | * | 3/1975 | Kawata | 126/271.2 B |
| 4,071,966 A | | 2/1978 | Cohen | |
| 4,226,034 A | | 10/1980 | Benjamin et al. | |
| 4,286,943 A | * | 9/1981 | Petlak et al. | 431/352 |
| 4,353,176 A | | 10/1982 | Hess | |
| 4,397,296 A | | 8/1983 | Moore, Jr. et al. | |
| 4,506,656 A | | 3/1985 | Baasch | |
| 4,615,129 A | | 10/1986 | Jackson | |
| 4,697,572 A | | 10/1987 | James et al. | |
| 4,768,495 A | | 9/1988 | Zifferer | |
| 4,846,148 A | | 7/1989 | Zifferer | |
| 5,235,762 A | | 8/1993 | Brady | |
| 5,266,220 A | | 11/1993 | Hammond et al. | |
| 5,342,482 A | | 8/1994 | Duesel, Jr. | |
| 5,566,231 A | | 10/1996 | Sizer, II | |
| 5,606,965 A | | 3/1997 | Panz et al. | |
| 5,615,668 A | | 4/1997 | Panz et al. | |
| 5,636,623 A | | 6/1997 | Panz et al. | |
| 5,758,605 A | | 6/1998 | Calkins | |
| 5,791,335 A | | 8/1998 | Luciani | |
| 5,956,872 A | | 9/1999 | Mavrianos | |
| 6,223,742 B1 | * | 5/2001 | Macameau | 126/343.5 R |

OTHER PUBLICATIONS

Tech Notes; "Submerged Combustion"; Section 3, Sheet L2; 1/90. (4 pp.).
Pewag Products; www.pewag.com; Scraper Conveyor Chain. (2 pp.).
Trecan Snowmelters; www.trecan/com; (5 pp.).
Prab Advantage; Conveyors (2 pp.).

* cited by examiner

*Primary Examiner*—Albert Basichas
(74) *Attorney, Agent, or Firm*—Renner, Otto, Boisselle & Sklar, LLP

(57) ABSTRACT

The present invention relates to a snow melting apparatus including a container for holding a snow melting medium and receiving the snow; and a burner having a combustion chamber, wherein at least a portion of the combustion chamber is submerged in the snow melting medium and the submerged portion of the combustion chamber includes a sparger tube through which combustion gases emerge into the snow melting medium. The present invention further relates to a mechanism for continuously removing debris from the snow melting apparatus.

25 Claims, 3 Drawing Sheets

SUBMERGED COMBUSTION SNOW MELTING APPARATUS

CROSS-REFERENCE TO RELATED APPLICATIONS

The present application is related and claims priority under 35 U.S.C. §119(e)(1), to U.S. provisional applications Serial No. 60/275,054, filed Mar. 12, 2001, and Serial No. 60/350,495, filed Nov. 13, 2001.

FIELD OF THE INVENTION

This invention relates to an apparatus for melting snow at the maximum rate and efficiency. More particularly, the present invention relates to a snow melting system including a sparger tube type submerged combustion apparatus.

BACKGROUND OF THE INVENTION

Submerged combustion is a method of heating whereby hot products of combustion are forced through a medium to heat the medium. The heat exchange occurs directly between the hot products of combustion and the medium, which may be water or an aqueous solution. In a submerged combustion system, the hot combustion products are generated by a flame fed by a combination of air and a suitable fuel. The flame typically does not actually come into contact with the medium. This technology differs from conventional heat exchange methods such as immersion tube heating where the heat exchange is indirect from combustion products to the tube and through the tube walls to the medium. In conventional heat exchange methods, the spent products of combustion are inefficiently exhausted directly to the atmosphere with useable heat remaining, rather than being efficiently exhausted through the medium and giving up all possible heat, as is possible in submerged combustion.

A problem which exists in high latitude regions is melting large quantities of snow which must be cleared in, e.g., a city or an airport in winter. A variety of apparatuses and methods have been proposed for melting large quantities of snow. Generally these apparatuses and methods include various means for heating water and transferring the water's heat to the snow. However, none of these methods efficiently combine high rates of heat transfer from the fuel to the water and from the water to the snow, as needed to achieve the maximum melt rate and fuel efficiency for melting snow.

Submerged combustion devices have been applied to the problem of heating water, both for production of hot water per se and for other applications such as melting snow. The submerged combustion devices used in prior art systems often employ a vertical combustor/weir style apparatus having a relatively small coverage area compared to the volume of water to be heated, in which the combustion gases are directed downwardly onto the liquid to be heated.

A weir type submerged combustion device includes two concentric vertical tubes of relatively short length. The tubes are vertically displaced, with the top and bottom of the outer tube (the weir tube) being lower than the respective top and bottom of the inner tube (the combustion tube). This tube system is vertically mounted and is partially immersed in the medium; usually about half the vertical length of the tubes are immersed. The bottom of the outer tube is located above the bottom of the medium container. In operation, the combustion products (hot gases) are directed downward against the surface of the medium in the inner tube. The hot gases are forced to pass downwardly through the medium, around the lower edge of the inner tube and up through the medium in the space between the inner tube and the outer tube. The hot gases entrain the medium and force it to rise in the space between the inner and outer tubes and then over the upper edge of the outer tube. At this point, the partially cooled gases escape upward and out of the device, while the entrained, warmed water flows downward on the outside of the outer tube and into the medium container thus mixing with the remainder of the medium. The only agitation of the medium is that provided by the water flowing into the bottom of the weir and out over the top edge of the outer tube.

The weir type of submerged combustion apparatus, while being currently used and thus the state of the art in snow melting, has shortcomings, in that it fails to completely transfer heat from the combustion gases into the liquid to be heated. The weir type of submerged combustion fails to achieve complete agitation of the container, and thus does not provide sufficient agitation of the snow melting water to rapidly melt the snow deposited in the snow melting apparatus. In addition, the lack of complete agitation results in non-uniform temperature distribution in the snow melting medium. Additional agitation must be provided from an external mixing device. Without adequate agitation, a problem arises due to accumulation of large masses of unmelted snow accumulated in the medium. The weir type of submerged combustion is inefficient in converting combustion heat to snow melting because the close contact of the flame with the water forms water vapor in the combustion chamber. These effects combine to limit the snow feed rate into the snow melting apparatus to less than what could be fed with full agitation and complete and uniform heat transfer.

In an attempt to overcome the problem of masses of unmelted snow resulting from the lack of agitation, users have increased the number of burners in a single snow melting tank. However, this solution merely shifts the location of the unmelted mass and, since each combustion unit provides only local agitation, does not solve the problem of inadequate agitation in the medium container as a whole. In addition, there are the additional capital and operating costs for the additional burners.

Thus, the needed agitation of the snow melting medium (e.g., water) has been left to the often inadequate passive mixing resulting from the water flow through the weir or has been provided by an external mixing device. The lack of agitation directly results in a reduced rate of snow melting and a loss in efficiency of fuel use as well. Other prior art systems include externally applied mechanical mixing devices, thus requiring the input of additional energy as well as provision of the additional equipment.

Due to these problems, snow melting has not been widely used. Instead, simple snow removal is often relied upon despite shortages of available disposal space and high transportation costs associated with snow removal.

An additional problem in the prior art has been the accumulation and concomitant requirement for removal of debris from snow melting operations. Accumulation of such debris is particularly problematical due to the wide variation in size and type of debris. For example, such debris may include sand, gravel, stones, glass shards and whole containers, wood, plastics of many shapes and sizes and various metallic objects which are inadvertently collected along with the snow. In prior art snow melting systems, the entire system must be shut down and the water drained out of the snow melting tank in order to gain access to and remove the debris collected with the snow. The problem is worse in cities than in controlled areas such as airports, but it is a general problem existing in snow melting operations. This requirement disrupts operations and wastes energy.

Therefore, a need remains for an apparatus and method which will rapidly and efficiently melt snow and provide for an efficient, continuous debris removal apparatus in association with the snow melting.

SUMMARY OF THE INVENTION

In one embodiment, the present invention relates to a snow melting apparatus including a container for holding a snow melting medium and receiving the snow; a submerged combustion burner; and a continuous debris removal mechanism.

In another embodiment, the present invention relates to a snow melting apparatus including a container for holding a snow melting medium and receiving the snow; a burner having a combustion chamber, wherein the combustion chamber comprises a sparger tube through which combustion gases emerge into, mix with and agitate the snow melting medium; and a continuous debris removal mechanism.

In one embodiment, the present invention relates to a snow melting apparatus comprising a container for holding a snow melting medium and receiving the snow; and a burner having a combustion chamber, wherein at least a portion of the combustion chamber is submerged in the snow melting medium and the submerged portion of the combustion chamber comprises a sparger tube through which combustion gases emerge into, mix with and agitate the snow melting medium. In one embodiment, substantially all of the combustion gases emerge into the snow melting medium.

In another embodiment, the present invention relates to a method of melting snow including steps of providing snow to a snow-melting apparatus, the snow-melting apparatus including a container, a submerged combustion burner and a continuous debris removal mechanism; operating the submerged combustion heating system to heat a snow melting medium which receives and melts the snow in the container; and continuously removing debris from the snow melting apparatus by means of the continuous debris removal mechanism. In one embodiment, the submerged combustion heating system includes a sparger tube.

In another embodiment, the present invention relates to a method of melting snow, comprising providing snow to a snow-melting apparatus, wherein the snow melting apparatus comprises a container for holding snow melting medium and receiving snow and a burner having a combustion chamber, wherein at least a portion of the combustion chamber is submerged in the snow melting medium and the submerged portion of the combustion chamber comprises a sparger tube; combusting fuel in the combustion chamber to form hot combustion gases; heating and agitating the snow melting medium by directly contacting the snow melting medium with the hot combustion gases exiting the sparger tube; and bringing the snow into contact with the heated snow melting medium to melt the snow.

Thus, the present invention relates to a snow melting apparatus in which water is the medium and which provides a high melt rate and high fuel efficiency. These benefits are attained by use of sparger tube submerged combustion, in which large volumes of hot combustion gases are brought rapidly, directly and intimately into contact with the snow melting medium. The hot combustion gases thereby both agitate a large portion or all of the snow melting medium and obtain nucleate boiling to most efficiently transfer heat from the hot combustion gases to the snow melting medium. Nucleate boiling provides much greater heat transfer from the hot combustion gases to the snow melting medium than does conduction or convection heating.

The present invention further relates to a snow melting apparatus including a mechanism for removing debris from the snow melting tank. In one embodiment, the snow melting apparatus includes a mechanism for continuously removing debris from the snow melting apparatus. In one embodiment, the mechanism for continuously removing debris from the snow melting apparatus includes a plate and flight conveyor, and in another embodiment, the mechanism for continuously removing debris from the snow melting apparatus includes a drag chain.

Accordingly, the present invention addresses and overcomes the problems of the prior art snow melting apparatuses. Additional features and benefits of the invention will be understood from the following detailed description.

DETAILED DESCRIPTION

Figure 1:
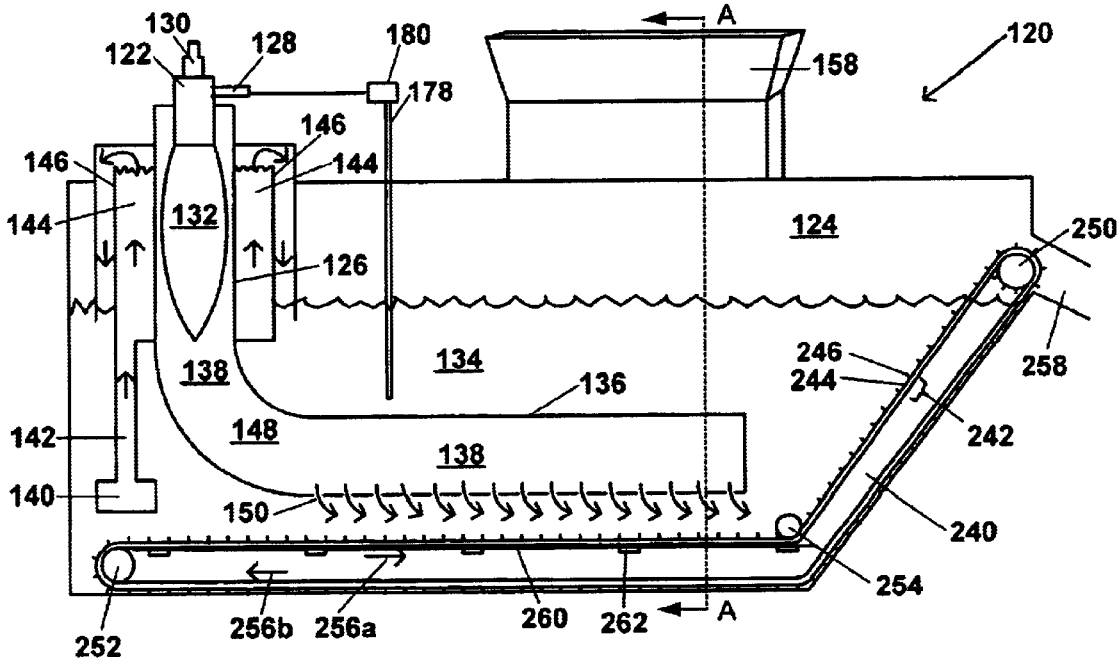
FIG. 1 is a schematic side sectional view of a snow melting apparatus in accordance with one embodiment of the present invention.

The present invention optimizes the rate of snow melting, i.e., the amount of snow melted per unit of time and energy input to the snow melting apparatus. The rate of snow melting is optimized by maximizing heat transfer from the burners to the snow by use of a sparger tube style of submerged combustion rather than the weir type, by the agitation provided by the sparger, by use of an optimum temperature and by the ability to continuously remove debris from the apparatus. These features enable the snow melting apparatus of the present invention to operate continuously and the maximum rate and efficiency.

A first feature of the present invention is the use of a sparger tube for distributing the submerged combustion burner gases evenly throughout the melting container and for providing agitation of substantially all of the snow melting medium. The sparger tube provides a very high efficiency of heat transfer from the fuel to snow melting medium and provides a high degree of agitation to the snow melting medium. The sparger tube rapidly delivers the heat to the total volume of the snow melting medium via nucleate boiling heat transfer, and the resulting agitation allows the melting medium to transfer its heat to the snow nearly as rapidly while allowing the temperature of the snow melting medium to remain relatively uniform.

A second feature of the present invention is the temperature of the snow melting medium during operation of the snow melting apparatus. This feature directly relates to attaining an excellent fuel use efficiency. Surprisingly, the present inventor has discovered that maintaining a low temperature in the snow melting medium leads to the optimum combination of fuel efficiency and snow melting rate. In one embodiment, the temperature of the snow melting medium is in the range from about 0° C. to about 25° C. In another embodiment, the temperature is in the range from about 10° C. to about 20° C.

The low temperature snow melting medium feature further enhances the fuel efficiency of the system by reducing water vapor formation, by not adding excess heat to the melt water exiting the snow melting apparatus, and by allowing large quantities of slush to be discharged from the snow melting apparatus, rather than having to completely melt the slush. This feature also avoids environmental losses of heat by reducing the temperature differential between the snow melting apparatus and the surrounding environment and by speeding the start-up time of the unit, since the water temperature only needs to be raised a relatively small amount for the snow melting operation to begin.

A third feature is the provision for debris removal from the snow melting apparatus. The present inventor has discovered a solution to the long-standing problem of debris accumulation in any kind of snow melting apparatus. In one embodiment, the debris is removed on a continuous basis, in one embodiment, by a hinged flight and plate type conveyor. In another embodiment, the continuous debris removal is by means of a drag chain type of continuous removal of small amounts of debris. The drag chain type of continuous debris removal enables the snow melting apparatus of the present invention to continue operating without the necessity of periodic shutdowns to clean out the debris.

As a result of these features, the snow melting apparatus of the present invention optimizes the amount of water heated and/or snow melted per unit of energy input to the water heating or snow melting apparatus, thus providing the most efficient possible continuous operation.

Throughout the disclosure of the present invention, including both specification and claims, in all numerical values, the limits of the ranges and ratios may be combined.

Sparger Tube

The apparatus of the present embodiment includes high rate direct heat transfer to the water from the combustion gases, such that the transfer is accomplished with minimum loss of the energy provided by the fuel. This highly efficient, high rate transfer of heat is accomplished by means of submerged combustion with a sparger tube for distributing the hot combustion gases to the snow melting medium. With sparger tube submerged combustion, no loss of heat transfer rate is encountered, such as due to, e.g., film resistance resulting from use of a heat exchange apparatus, or to inefficient mixing of the hot gases with the snow melting medium and subsequent escape of only partially cooled combustion gases.

The apparatus of the present invention avoids the loss in efficiency of heat transfer inherent in any device which does not include sparger tube-type submerged combustion heating. In sparger tube submerged combustion snow melting apparatus, the heat generated by combustion of a fuel is transferred directly into the snow melting medium and snow. The sparger tube provides both more efficient heat transfer to and agitation of the snow melting medium. Incoming snow is rapidly mixed with the snow melting medium already in the container, and is rapidly and efficiently melted.

The use of sparger tube submerged combustion provides excellent fuel efficiency. The apparatus of the present invention obtains excellent fuel efficiency in part because the hot combustion gases transfer substantially 100% of the heat contained therein to the water or snow melting medium through nucleate boiling. The lack of intermediate devices or barriers between the combustion chamber and the water or snow melting medium means that there is no heat loss and no slowing of the process of heat transfer from the combustion gases to the water or snow melting medium.

An additional feature of the present invention which further distinguishes it from prior art devices is that the force of the hot combustion gases exiting the sparger tube and mixing with the water or snow melting medium in the container provides highly agitated thorough mixing of the hot combustion gases with the snow melting medium for efficient melting of the snow. Thus, no separate, additional apparatus for agitation of the water or snow melting medium needs to be provided. The temperature and velocity of the hot (i.e., about 1300° C. to about 1800° C.) combustion gases result in nucleate boiling and strong agitation of the water or snow melting medium. The nucleate boiling provides maximum heat transfer rate of heat from the combustion gases to the water or snow melting medium. The strong agitation of the water or snow melting medium results in maximum heat transfer rate of heat from the snow melting medium to the incoming snow.

Temperature of the Snow Melting Medium

A significant and unexpected aspect of the present invention is the optimum temperature of the snow melting medium. A person might expect the maximum snow melting rate and the most efficient operation of the snow melting apparatus would be when the temperature of a snow melting medium is high, i.e., in the range from about 45° C. to at least about 90° C. or higher. Surprisingly, the present inventor has discovered that the optimum target or set-point temperature of the snow melting medium, which provides the maximum rate of snow melting at the maximum efficiency of fuel use, is in the range from about 10° C. to about 40° C., in another embodiment, from about 12° C. to about 20° C., and in another embodiment, from about 15° C. to about 17° C. In another embodiment, the snow melting medium is maintained at a target temperature in the range from about 5° C. to about 25° C. In another embodiment, the snow melting medium is maintained at a target temperature in the range from about 10° C. to about 20° C.

It should be recognized that the foregoing temperature ranges are set-point ranges, i.e., a target range, and that variations will occur. For example, when a large quantity of snow is dumped into the snow melting apparatus, the temperature of the snow melting medium in the vicinity of the newly added snow will likely fall to about 0° C., due to the low temperature of the snow. The mixing of the snow melting medium is expected quickly to melt the snow and raise the temperature of the snow melting medium.

The snow melting medium may be maintained at a selected target temperature, or the temperature may be allowed to fluctuate depending on the heat consumed in melting the possibly varying quantities of snow provided to the container. The snow melting medium should be maintained at the lowest possible temperature consistent with efficient melting of the snow. This temperature is about 10° C. Of course the temperature should not be too low. If the snow melting medium is targeted to temperature lower than about 10° C., it will melt the snow, but the melting rate may be reduced significantly compared to snow melting medium at somewhat higher temperatures. Similarly, while the snow melting medium may be used at temperatures higher than about 40° C., increasing quantities of heat are lost at higher temperatures, and significant quantities of heat may be diverted to vaporizing the snow melting medium rather than significantly increasing the rate at which snow is melted.

Size Reduction of Bulk Snow Feed

The snow may be provided to the snow melting apparatus in any form. However, in a practical situation, the snow is most likely to be provided in bulk form. The bulk form may be delivered to the snow melting apparatus from, e.g., a front-loader or a dump truck. For maximum melting rate and maximum efficiency, the snow should be introduced into the snow melting medium in a relatively low weight to surface area form. That is, the snow should be provided in small chunks or pieces, rather than in large bulky masses. "Smaller pieces" is defined herein to include pieces having a size in the range from about 6 inches to about 20 inches, in the largest dimension. The pieces are usually in irregularly sized chunks.

Thus, it may be necessary to provide a means for breaking up the bulk form snow into smaller pieces, having a reduced size. In one embodiment, the snow is provided from a front loader and is passed through a grating which causes the bulk snow to be broken into smaller pieces. By the time snow has been collected, it may be in such a compact form (akin to a block of ice) that a passive device such as a grating may not be adequate. Thus, in one embodiment, a chopping device, with rotating blades similar to those in a snow blower may be included.

In one embodiment, the snow may be provided from a snow blower. A snow blower allows control of and therefore more even distribution of the snow into the apparatus. In one embodiment, a snow blower and a snow distribution duct may be provided to collect and evenly distribute the snow into the snow melting apparatus. An equivalent system, such as a brush-type roller, or a standard snow plow blade adapted to funnel the snow into a chute similar to the snow distribution duct and thence into the container. In another embodiment, bulk snow may be provided to a chopping device similar to a snow blower, which is used to render the bulk snow into a smaller size, and then to transfer it to the container. Thus, the snow blower may constitute a device for breaking up bulk lumps of snow.

In another alternate embodiment, the snow is provided in a low weight to surface area form by funneling snow from a standard snow plow to the snow melting medium of the present invention. In this embodiment, the snow exiting the blade of the snow plow may be funneled through an appropriately configured duct to the apparatus, which may be mounted on a truck or other suitable vehicle.

While heat transfer is more rapid when the snow is provided in a low weight to surface area form, in practice this may not be possible. Thus, in another embodiment, the snow is provided in bulk quantities, such as by a front loader or even by the shovel-full. In such an embodiment, it may be helpful to provide some means for breaking up large clumps of compacted snow and/or ice into smaller particle sizes. In one embodiment, such means for breaking up the clumps include a screen or heavy wire mesh cover over the container of snow melting medium. Thus, for example, the mesh cover may be comprised of heavy steel stock, such as bar or rod stock, having a cross-sectional area in the range from about 0.25 to 1 or more square inches (i.e., about 1 to about 6 or more square centimeters), arranged, e.g., in a mesh of squares of about 4 to about 8 inches on each side. When a large mass of compacted snow is dropped onto such a grating, the masses of snow may be effectively broken into a smaller form more amenable to melting. In another embodiment, when the snow is in harder or more solid masses, the means for breaking up the masses may include applications of mechanical force, such as vibration, chopping or cutting or otherwise actively breaking apart large clumps of snow. Such applications of mechanical force may include use of reciprocating or rapidly rotating blades, such the blades in a snow blower.

Debris Removal

In one embodiment, the present invention provides for removal of debris from the snow melting apparatus. In one embodiment, the snow melting apparatus includes an apparatus for continuous debris removal. In one embodiment, the continuous debris removal is by a continuous chain apparatus. The continuous chain apparatus provides a simple, continuous mechanism for removal of debris which settles to the bottom of the container of the snow melting apparatus. The continuous chain apparatus may have any suitable configuration.

In one embodiment, the apparatus for continuous debris removal is a hinged flight and plate type of apparatus, in which a plate is carried by one or more links of a chain, and each plate is associated with a flight which extends perpendicular to a plane formed by the plate. In one embodiment, the flight extends across substantially the full width of the plate. In another embodiment, the flight extends beyond the outward edges of the plate. In the hinged flight and plate type conveyor, the plate forms a surface upon which the debris may settle, while the flight forms a surface which assures that the debris is pushed in the direction of movement of the conveyor.

In another embodiment, the apparatus for continuous debris removal is a drag chain clean-out mechanism, which comprises a drag chain of the sort used, for example, in an agricultural manure spreader. Such a simple drag chain generally includes parallel chains connected and held in fixed relationship to each other by a cross member. The cross member may be in the form of a bar of round stock, square stock or other suitable cross-sectional shape material. In another embodiment, the drag chain apparatus is of the type used in a sewage treatment plant for removing sewage sludge from digestion tanks and other impoundments. This drag chain may be similar to that described for agricultural uses.

Embodiments Illustrated in the Drawings

Figure 2:
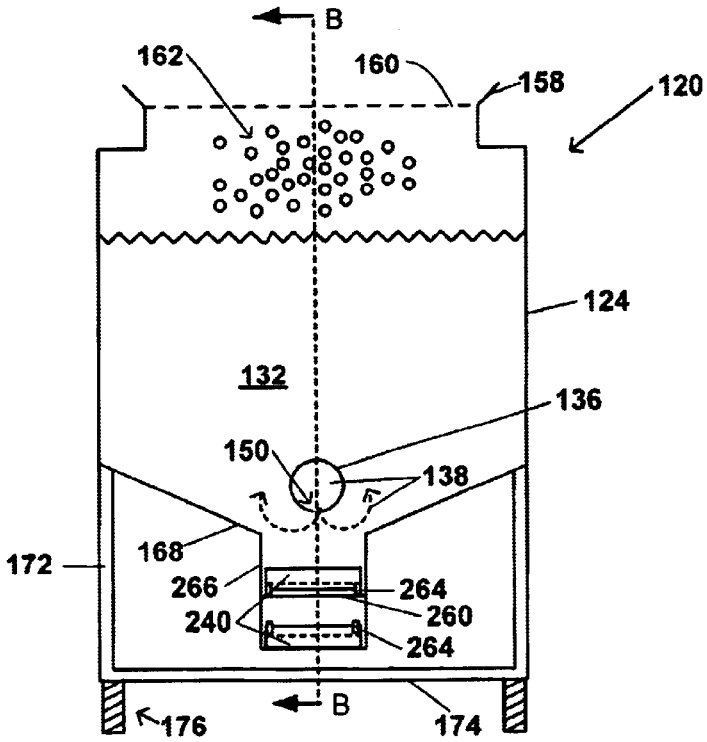
FIG. 2 is a cross-sectional view of the snow melting apparatus of FIG. 1 taken at line A—A of FIG. 1.

Referring now to FIGS. 1 and 2, there is shown a snow melting apparatus 120 in accordance with an embodiment of the present invention. FIG. 1 is a schematic cross-sectional view of this embodiment of the snow melting apparatus, taken at line B—B of FIG. 2. FIG. 2 is a schematic cross-sectional view of this embodiment of the snow melting apparatus, taken at line A—A of FIG. 1.

Referring to FIG. 1, there is shown a snow melting apparatus 120 in accordance with a first embodiment of the present invention. In the following description, the snow melting medium is water, and the parts and operation of the apparatus are described with reference to water. It is to be understood that while the snow melting medium is generally water formed by the melted snow, a significant quantity of salts, oil, dirt and other debris may be in the water at any given time.

The snow melting apparatus 120 includes at least one burner 122, a container 124, and a combustion chamber or tube 126. The burner 122 may be a conventional multi-fuel burner. The burner 122 includes a fuel line 128 through which fuel is provided to the burner 122, and an air line 130, through which combustion air is provided to the burner 122. When the fuel is burning, a flame 132 is directed downwardly into the submerged portion of the combustion chamber 126. As noted above, in another embodiment, two or more burners may be included in a single apparatus 120.

The burners used in the present invention may be operated on any of several different fuels. The burners may use natural gas, LP gas, propane, butane, diesel oil, kerosene, gasoline, heating oil, or other hydrocarbon fuel. In one embodiment, the burners of the present invention are operated on propane. For environmental reasons, a fuel such as propane, butane, natural gas or LP gas may be preferred. For mobile applications, No. 2 diesel fuel may be preferred, particularly when the vehicle operates on the same fuel.

The container 124 contains a snow melting medium 134. In one embodiment, the snow melting medium 134 is water. In one embodiment, the snow melting medium 134 comprises water, melted snow and other materials as noted above.

Each burner 122 is mounted on the apparatus 120 is a position in which the burner(s) and the combustion chamber (s) are at least partially submerged in the snow melting medium 134 in the container 124. As shown in FIG. 1, the burner 122 and the combustion chamber 126 are mounted at a downward angle. The apparatus 120 further includes at least one sparger tube 136 connected to each burner 122 and combustion chamber 126. The sparger tube 136 is completely submerged in the snow melting medium 134. Other mounting configurations of the burner 122 and the combustion tube 126 may be used as needed, and are within the scope of the present invention. However, the most efficient operation is obtained when at least a substantial portion of the combustion chamber 126 and all of the sparger tube 136 are submerged in the snow melting medium 134.

As the fuel is consumed, the combustion flame 132 emanates from the burner 122 into the combustion chamber 126, generating hot combustion gases 138. The hottest part of the combustion gases 138 are near the flame in the combustion chamber 126. As the hot combustion gases move away from the flame 132, heat is transferred to the snow melting medium surrounding the submerged apparatus and the sparger tube 136.

Figure 4:
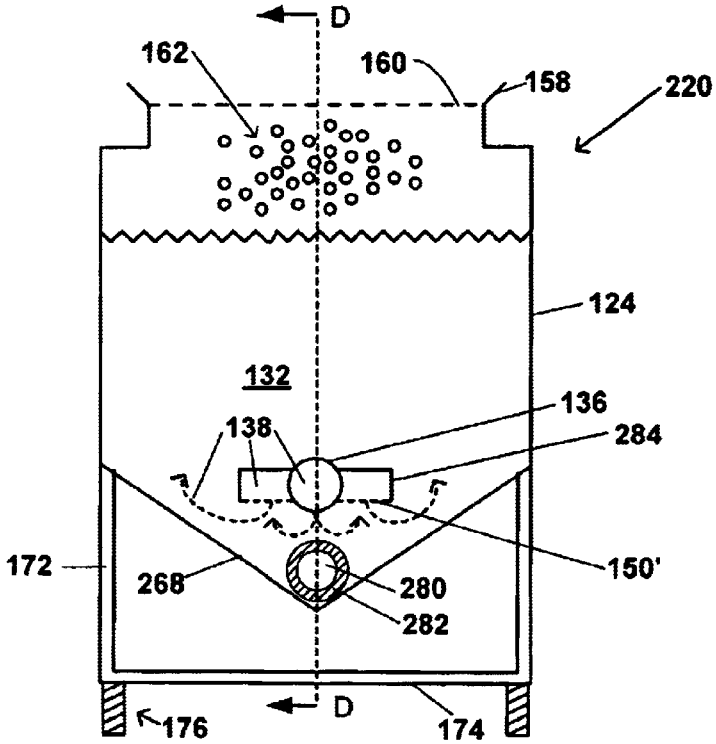
FIG. 4 is a schematic cross-sectional view of the snow melting apparatus of FIG. 3 taken at line C—C of FIG. 3.

In one embodiment, shown in FIG. 4, the sparger tube 136 includes additional, laterally extending sparger tube arms 284. The arms 284 extend laterally, horizontally, outward from the main sparger tube 136.

In one embodiment, the snow melting apparatus 120 further includes a pump 140 and a transfer line 142 which pumps a portion of the snow melting medium 134 into a contact space 144 surrounding the outside of the combustion chamber 126, then over a weir 146 and back into the main portion of the snow melting medium 134. The pumping of a portion of the snow melting medium around the combustion chamber 126 keeps the combustion chamber cool and allows transfer of some heat from the hot combustion gases 138 passing through this portion of the burner 122 to the snow melting medium 134. Provision of this additional contact space 144 also prevents loss of radiant heat from the portion of the combustion chamber 126 which is not actually submerged, i.e., below the liquid level of, the snow melting medium 134 in the container 124. The remainder of the combustion gases 138 pass through an area reduction or transition zone 148 into the sparger tube 136. The sparger tube 136 includes a plurality of exit ports 150. The hot combustion gases 138 pass through the exit ports 150 to be mixed with, to transfer heat to, and to agitate the snow melting medium 134. In one embodiment, the apparatus 120 does not include the additional contact space 144. In one embodiment, the water level is maintained higher in the container 124 than shown in FIG. 1, so that heat from the combustion chamber 126 is not lost to the air space in the container 124, but is instead passed directly into the medium 134.

As shown in FIG. 1, each sparger tube 136 is mounted such that its longitudinal axis is oriented generally horizontally. The exit ports 150 are disposed on the lower side of the sparger tube 136, so that the hot combustion gases 138 are forced to pass in a radially downward direction in exiting from the sparger tube 136, thus providing maximum contact with the snow melting medium 134. In one embodiment, the exit ports 150 are in the form of slits. In the embodiment shown in FIG. 1, the exit ports 150 are placed on the lowest portion of the sparger tube 136. In other embodiments, the exit ports 150 may be placed elsewhere on the sparger tube 136, so that the combustion gases 138 would pass radially outward to the side and down or simply to the side. While it is possible to have these or other orientations of the exit ports 150, such orientations may provide less thorough contact between the hot combustion gases 138 and the snow melting medium 134 in the container 124, and therefore may provide less efficient heat transfer to and less agitation of the snow melting medium. For this reason, these embodiments are less preferred than embodiments in which the exit ports 150 provide a downwardly oriented exit from the bottom of the sparger tube 136.

The hot combustion gases 138 in the sparger tube 136 may have a temperature in the range from about 800° C. to about 1650° C. In one embodiment, the hot combustion gases 138 in the sparger tube 136 may have a temperature in the range from about 1200° F. to about 1500° C. In one embodiment, the hot combustion gases 138 in the sparger tube 136 have a temperature of about 1400° C.

As the hot combustion gases 138 pass from the sparger tube 136 through the exit ports 150 into the snow melting medium in the container 124, the temperature of the combustion gases 138 rapidly drops as the heat content of these gases is transferred to the snow melting medium 134 via nucleate boiling. As the combustion gases 138 mix with and give up their heat to the snow melting medium 134, the temperature of the combustion gases drops to about the temperature of the snow melting medium 134. The temperature of the snow melting medium may be controlled by, e.g., a standard thermocouple device which throttles the fuel input based on the temperature of the snow melting medium.

As shown in FIG. 1, the snow melting apparatus 120 further includes a thermocouple 178 and a burner controller 180. The thermocouple 178 is mounted so as to be in contact with the snow melting medium 134, in order to provide temperature data to the burner controller 180. The burner controller 180 is programmed to control the firing rate of the burner 122, including control of one or both of the air flow rate and the fuel flow rate, as delivered by the fuel line 128 and the air line 130. The burner controller 180 may include, e.g., a thermostat and valve control devices for the requisite flow adjustments of the fuel line 128 and the air line 130, as required based on the temperature of the snow melting medium 134, which may vary depending on the quantity of incoming snow.

Referring now to FIG. 2, which schematically illustrates a cross-sectional view of the snow melting apparatus 120 shown in FIG. 1, taken along line A—A in FIG. 1, the invention is further described.

Referring to FIG. 2, in one embodiment, the snow melting apparatus 120 includes a sloped bottom section 168. The sloped bottom section 168 facilitates the movement of debris towards the downwardly extending portion 266 of the bottom of the snow melting apparatus 120, in which the debris removal mechanism is located.

Referring to FIG. 2, as described with respect to FIG. 1, hot combustion gases 138 pass from the sparger tube 136 through the exit ports 150 and mix with the snow melting medium 134. The hot combustion gases 138 mix with the snow melting medium 134 in the container 124. The cooled combustion gases 138, together with air entrained in the snow, pass up through the medium (shown by the dashed lines emerging from the slits 150 in the bottom of the sparger tube 136 in FIG. 2), and exit the apparatus 120 into the surrounding ambient air through a debris removal port 250 described below, and through a snow-entry chute 158, described below.

As shown in FIG. 2, in one embodiment, the container 124 may be mounted on support legs 172. The support legs 172 may be conventional tank support legs, formed of, e.g., I-beams or channel. In one embodiment, the entire snow melting apparatus is mounted on the legs 172. In one embodiment, the legs 172 are attached to each other by horizontally disposed, ground-contacting skids 174. In one embodiment, the lower end of the legs 172 are affixed to the bed of a truck (not shown). The truck bed may be in a flatbed truck or a semi-trailer truck. In one embodiment, the entire snow melting apparatus is carried on a mobile vehicle. In one embodiment the mobile vehicle also includes snow collection means, such as a snow plow, a transporting conveyor or the snow blower 156. In one embodiment, the snow melting apparatus 120 is mounted on springs or other shock- and/or vibration-absorbing devices, or these may be included as an integral part of the legs 172. The springs may be useful because submerged combustion apparatus may generate harmonic vibrations which the user may wish to damp in order to avoid the vibration.

As schematically shown in FIGS. 1 and 2, the snow melting apparatus includes a snow receiving opening or chute 158. The chute 158 may be any appropriate size. For example, the chute 158 may be rectangular, having a length of about 8 to about 10 feet, and a width of about 4 to about 6 feet. This size should be adequate to accommodate a load from a large front-end loader, or from a dump truck. The chute 158 may be appropriately configured, including an enlarged opening, means for breaking up large masses of snow, and otherwise as needed. The snow melting apparatus 120 may be disposed such that front-end loaders, for example, can deposit snow from one side or both sides simultaneously. The snow melting apparatus 120 may be large enough and may be situated such that dump trucks may discharge an entire load of collected snow en masse.

As shown schematically in FIG. 2, the chute 158 may include a screen or grating 160 for breaking large masses of snow into a smaller size. Such means for breaking up large masses of snow are discussed above in more detail. FIG. 2 schematically shows smaller size snow 162 passing through the chute 158 toward the snow melting medium 134.

As schematically shown in FIGS. 1 and 2, in one embodiment, the snow melting apparatus includes a clean-out mechanism which comprises a continuous debris removal mechanism 240. As used herein, the term "continuous debris removal mechanism" refers to any continuous, bulk conveyor suitable for use with the present invention, as described herein. In one embodiment, the continuous debris removal mechanism comprises a flight and plate type conveyor, described in more detail below. In another embodiment, the continuous debris removal mechanism comprises a continuous chain of plate-like elements having outwardly protruding flights, the mechanism moving on and supported by rollers. In another embodiment, the continuous debris removal mechanism includes a drag chain, such as that used in agriculture for spreading manure or in a sewage treatment plant for removal of sludge. In one embodiment, the drag chain comprises rollers. In another embodiment, the drag chain does not include rollers, but simply drags along support surfaces, such as described below.

A continuous debris removal mechanism, such as the flight and plate or drag chain mechanisms, is most useful for the purpose or removing debris from the snow melting apparatus 120, because it is capable of handling debris having widely varying sizes, and removing it from the snow melting apparatus on a continuous basis. Since varying amounts of debris may be entrained in the snow received by the apparatus 120, the continuous debris removal prevents buildup of such debris. Since the snow is generally collected in bulk, it is likely to be laden with a variety of debris, as described above.

A flight and plate type embodiment of the continuous debris removal mechanism 240 is shown in FIG. 1. The continuous debris removal mechanism 240 shown in FIG. 1includes a plurality of plate-type elements 242. Each 242 includes a plate-like linking portion 244 and a flight 246. In one embodiment, the flight 246 is an outwardly projecting plate-like element which may be formed from a suitable structure, such as a stainless or mild steel L-angle. The extension of the flight 246 above the plane defined by the plate-like linking portion 244 is selected as appropriate, and may range, for example from about ½ inch to about 4 to 6 inches above the plane defined by the plate-like linking portion 244.

In one embodiment, the width of the flight 246 extends substantially the entire width of a downwardly extending portion 266 (shown in FIG. 2), in which the drag chain mechanism 240 operates. In one embodiment, the width of the flights 246 on the continuous debris removal mechanism 240 extend substantially the entire width of the snow melting apparatus 120. As will be recognized by those of skill in the continuous debris removal art, the continuous debris removal embodiment described here is substantially similar to that used in a quench tank in a metal casting or heat treating operation.

Each element 242 further includes a linking mechanism (not shown) by which the element 242 is linked to the neighboring elements, to which it is interconnected. In addition, each element 242 may include a roller (not shown in FIG. 1; see FIG. 2 and accompanying text) for facilitating movement of the continuous debris removal mechanism 240 over a supporting surface. Although the linking mechanism and the roller are not shown in FIG. 1, a person of skill in the art will easily be able to select a suitable linking mechanism and roller element as needed.

As shown in FIG. 1, the continuous debris removal mechanism 240 moves about a set of sprockets. In the embodiment shown in FIG. 1, the continuous debris removal mechanism 240 includes a drive sprocket 250, and tail sprocket 252 and an idler 254. The continuous debris removal mechanism shown in FIG. 1 moves in the directions shown by the arrows 256*a* and 256*b*. Thus, debris which falls on the mechanism 240 from above is carried to the right side of the apparatus in the direction of the arrow 256*a*, up the slope, and is dropped onto the exit chute 258. The exit chute 258 leads to the exterior of the snow melting apparatus 120, where the removed debris is deposited for collection and removal as appropriate. The elements 242 of the continuous debris removal mechanism 240 then return in the direction of the arrow 256*b*.

Figure 5:
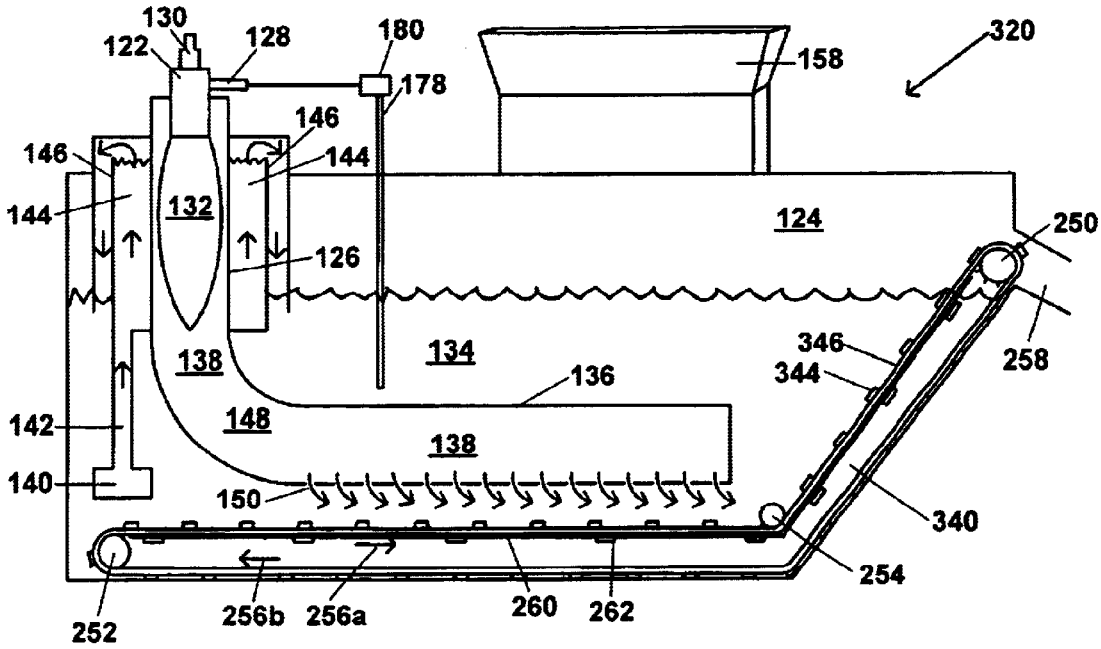
FIG. 5 is a schematic side sectional view of a snow melting apparatus in accordance with yet another embodiment of the present invention.

FIG. 1 schematically shows a support plate 260 and transverse support beams 262. The support plate 260 provides a flat surface upon which the rollers can roll, or upon which the continuous debris removal mechanism 240 may be moved. The support plate 260 may be supported by a plurality of the transverse support beams 262, as shown in FIG. 5.

FIG. 2 is a schematic cross-sectional view of the snow melting apparatus 120 of FIG. 1, taken at line A—A of FIG. 1. As shown in FIG. 2, the continuous debris removal mechanism 240 may include a set of rollers 264. The rollers 264 shown in the embodiment of FIG. 2 are wheels. In other embodiments, the rollers 264 may be an elongated cylindrical roller. In one such embodiment, the elongated cylindrical roller 264 extends substantially across the width of the continuous debris removal mechanism 240. FIG. 2 shows the support plate 260 upon which the continuous debris removal mechanism 240 moves.

As shown in FIG. 2, in one embodiment, the continuous debris removal mechanism 240 is located in a downwardly extending section 266 of the container 124 of the snow melting apparatus 120. In one embodiment, the width of the continuous debris removal mechanism 240 is substantially the same is the width of the downwardly extending section 266. Thus, the continuous debris removal mechanism 240 occupies a side-to-side space substantially the same as the inside width of the downwardly extending section 266.

Figure 3:
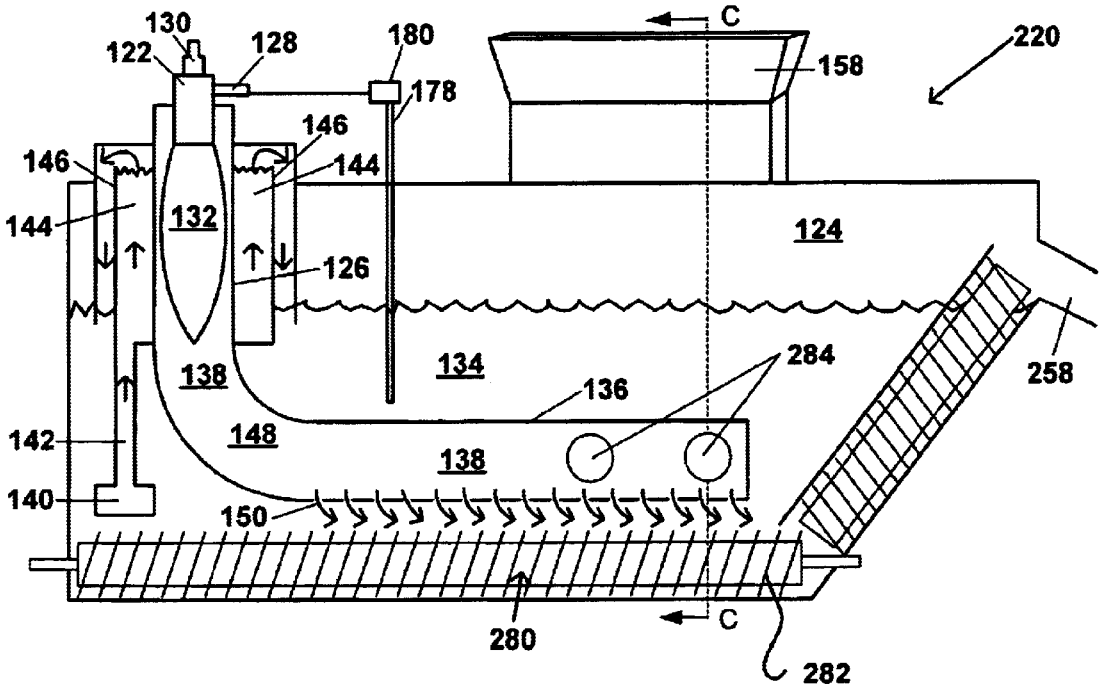
FIG. 3 is a schematic side sectional view of a snow melting apparatus in accordance with another embodiment of the present invention.

Referring now to FIGS. 3 and 4, there is shown a snow melting apparatus 220 in accordance with an embodiment of the present invention which Includes an auger-type debris removal device 280. FIG. 3 is a schematic cross-sectional view of this embodiment of the snow melting apparatus, taken at line D—D of FIG. 4. FIG. 4 is a schematic cross-sectional view of this embodiment of the snow melting apparatus, taken at line C—C of FIG. 3. The auger debris removal device 280 includes spiral blades or flights 282, as shown in FIGS. 3 and 4. The auger debris-removal device 280 is shown in FIG. 4 in a V-shaped bottom 268. The auger debris-removal device 280 operates by rotating with the spiral blades or flights 282 advancing the debris towards the exit chute 258. As shown in FIG. 4, in one embodiment, the sparger tube 136 includes laterally extending sparger tube arms 284. The arms 284 include exit ports 150', similar to the exit ports 150.

Referring now to FIG. 5, there is shown a snow melting apparatus 320 in accordance with an embodiment of the present invention which includes a drag chain debris removal device 340. The drag chain debris removal device 340 operates in a manner substantially similar to the flight and plate embodiment of the continuous debris removal mechanism shown in FIGS. 1 and 2, except that the drag chain debris removal device 340 Includes a plurality of bar members 344 which are connected to each other by a chain 346 or other connection, as known in the drag chain art.

Since the apparatus of the present invention is likely to encounter a number of corrosive elements while in use, and in particular, salt used on roadways, the apparatus should be manufactured from a corrosion resistant material, such as stainless steel, fiberglass or other suitable materials. In one embodiment, the user may provide a suitable container 124, into which the remainder of the apparatus described herein can be installed. Some elements, such as the continuous debris removal mechanism, may be made of a softer mild steel, so that it is the more easily replaceable elements of the continuous debris removal mechanism which preferentially wears down, rather than the integral structure of the snow melting apparatus. The continuous debris removal mechanism 240 is removable as an integral unit, or may be partially disassembled for repair or part replacement.

Method of Melting Snow

The present invention further relates to a method of melting snow. In one embodiment, the method of melting snow includes steps of providing snow to a snow-melting apparatus, the snow-melting apparatus including a container, a submerged combustion burner and a continuous debris removal mechanism; operating the submerged combustion heating system to heat a snow melting medium which receives and melts the snow in the container; and continuously removing debris from the snow melting apparatus by means of the continuous debris removal mechanism. In one embodiment, the submerged combustion burner includes a sparger tube for distributing hot combustion gases to and for agitating the snow melting medium, as described above.

The method of melting snow, in one embodiment, includes steps of providing snow to a snow-melting apparatus, wherein the snow melting apparatus includes: a container for holding snow melting medium and receiving snow; a burner having a combustion chamber, wherein at least a portion of the combustion chamber is submerged in the snow melting medium and the submerged portion of the combustion chamber comprises at least one sparger tube; combusting fuel in the combustion chamber to form hot combustion gases; heating and agitating the snow melting medium by directly contacting the snow melting medium with the hot combustion gases exiting the sparger tube; and bringing the snow into contact with the heated snow melting medium to melt the snow.

In one embodiment, the method further includes removing from the snow melting apparatus stones, glass, plastic, metals and any other debris which may be picked up with the snow and find its way into the snow melting apparatus. In one embodiment, the removing step is carried out with a continuous debris removal mechanism, as described above. In other embodiments, the removing step is carried out by using other known means for removing debris or solid matter from the bottom of a container filled with liquid, such as an auger. Such other methods may also include manually removing the debris, and may entail first emptying the tank of liquid contained therein.

The method may be carried out with the apparatus mounted on a truck, for example. The truck may be equipped with a snow plow or a snow blower, including the necessary apparatus for collecting and providing the snow to the snow melting apparatus. The snow melting apparatus has been described above in detail. The burner is fired to heat the snow melting medium to a proper temperature, as suggested above, in one embodiment in the range from about 5° C. to about 40° C., in another embodiment, in the range from about 10° C. to about 20° C., in another embodiment, in the range from about 12° C. to about 18° C., in another embodiment, from about 14° C. to about 16° C., and in one embodiment, about 15° C. As the particles or lumps of snow are collected by the collecting means, if necessary lumps or compacted masses are reduced to a low weight to surface area size, then the snow is passed into the snow melting medium and rapidly melted. The melt water may be simply ported overboard to a storm gutter or sewer, or if necessary, transferred to a water receiving tank, if simply dumping the water is not acceptable. In an embodiment in which the apparatus is vehicle-mounted, the water receiving tank may be mounted on the same vehicle, may be contained in a trailer attached to the vehicle, or may be on a separate vehicle. Thus, the snow melting apparatus of the present invention may be a self-contained unit, including a vehicle, fuel supply, electrical controls, etc., as needed for fully independent operation. The invention is not limited by the means by which it may be transported.

In one embodiment (not shown), the container 124 has a V-shape bottom leading to a clean-out port. The V-shape bottom may be used to collect debris for removal through the clean-out port. In one embodiment, the clean-out port may be equipped with an auger for removing debris from the bottom of the container 124 through the clean-out port. The auger may be any appropriate device, such as a screw-type device, for moving debris collected in the bottom of the tank towards the clean-out port.

Although the invention has been shown and described with respect to certain preferred embodiments, equivalent alterations and modifications will occur to others skilled in the art upon reading and understanding this specification and the annexed drawings. In particular regard to the various functions performed by the above described integers (components, assemblies, devices, compositions, steps, etc.), the terms (including a reference to a "means") used to describe such integers are intended to correspond, unless otherwise indicated, to any integer which performs the specified function of the described integer (i.e., that is functionally equivalent), even though not structurally equivalent to the disclosed structure which performs the function in the herein illustrated exemplary embodiment or embodiments of the invention. In addition, while a particular feature of the invention may have been described above with respect to only one of several illustrated embodiments, such feature may be combined with one or more other features of the other embodiments, as maybe desired and advantageous for any given or particular application.

What is claimed is:

1. A snow melting apparatus comprising:

a container for holding a snow melting medium and receiving the snow; and a burner having a combustion chamber, wherein the combustion chamber extends downwardly into and is at least partially submerged in the snow melting medium and the submerged portion of the combustion chamber communicates with a generally horizontally extending sparger tube, and wherein the sparger tube includes exit ports through which combustion gases emerge into, mix with and agitate the snow melting medium, and wherein the combustion gases are directed toward the bottom of the container at solid snow and/or ice collected therein.

2. The snow melting apparatus of claim 1, wherein the apparatus includes means for breaking large masses of snow into a smaller mass.

3. The snow melting apparatus of claim 1, wherein the snow melting medium in the container is agitated only by hot combustion gases emerging from the sparger tube.

4. The snow melting apparatus of claim 1, wherein substantially all of the combustion gases emerge from the sparger tube.

5. The snow melting apparatus of claim 1, further comprising a continuous debris removal mechanism.

6. The snow melting apparatus of claim 5, wherein the continuous debris removal mechanism comprises a plate and flight conveyor.

7. The snow melting apparatus of claim 5, wherein the continuous debris removal mechanism comprises a drag chain.

8. The snow melting apparatus of claim 1, wherein the container further comprises a V-shaped bottom and an auger for removing debris from the container.

9. The snow melting apparatus of claim 1, wherein the apparatus is mobile.

10. The snow melting apparatus of claim 1, wherein the snow melting medium is water.

11. The snow melting apparatus of claim 1, wherein the sparger tube further comprises laterally extending arms.

12. A method of melting snow, comprising:

providing snow to a snow-melting apparatus, wherein the snow melting apparatus comprises:

a container for holding snow melting medium and receiving snow;

a burner having a combustion chamber, wherein the combustion chamber extends downwardly into and is a least partially submerged in the snow melting medium and the submerged portion of the combustion chamber communicates with a generally horizontally extending sparger tube and wherein the sparger tube includes exit ports;

combusting fuel in the combustion chamber to form hot combustion gases;

heating and agitating the snow melting medium by directly contacting the snow melting medium with the hot combustion gases exiting the sparger tube;

bringing the snow into contact with the heated snow melting medium to melt the snow and directing the combustion gases toward the bottom of the container at solid snow and/or ice collected therein.

13. The method of melting snow according to claim 12, wherein the snow melting medium is water.

14. The method of melting snow according to claim 12, wherein the apparatus includes means for breaking large masses of snow into a smaller mass.

15. The method of melting snow according to claim 12, further comprising removing debris from the snow melting apparatus with a continuous debris removal mechanism.

16. The method of melting snow according to claim 15, wherein the continuous debris removal mechanism comprises a plate and flight chain element.

17. The method of melting snow according to claim 15, wherein the continuous debris removal mechanism comprises a drag chain.

18. The method of melting snow according to claim 12, wherein the snow melting medium Is maintained at a target temperature in the range from about 5° C. to about 40° C.

19. The method of melting snow according to claim 12, wherein the snow melting medium is maintained at a target temperature in the range from about 10° C. to about 25° C.

20. The method of claim 12, wherein the sparger tube further comprises laterally extending arms.

21. A snow melting apparatus comprising:

a container for holding a snow melting medium and receiving the snow;

a burner having a submerged combustion chamber, wherein the combustion chamber extends downwardly into and is at least partially submerged in the snow melting medium and communicates with a generally horizontally extending sparger tube and wherein the sparger tube includes exit ports through which combustion gases emerge into, mix with and agitate the snow melting medium and wherein the combustion gases are directed toward the bottom of the container at solid snow and/or ice collected therein; and a continuous debris removal mechanism.

22. The snow melting apparatus of claim 21, wherein the apparatus includes means for breaking large masses of snow into a smaller mass.

23. The snow-melting apparatus of claim 21, wherein the sparger tube further comprises laterally extending arms.

24. A method of melting snow comprising:

providing snow to a snow-melting apparatus, the snow-melting apparatus including a container, a submerged combustion burner extending downwardly into a snow melting medium and communicates with a generally horizontally extending sparger tube and wherein the sparger tube includes exit ports, and a continuous debris removal mechanism;

operating the submerged combustion burner to heat the snow melting medium which receives and melts the snow in the container with hot combustion gases exciting the sparger tube through the exit ports, and directing the combustion gases toward the bottom of the container at solid snow and/or ice collected therein; and continuously removing debris from the snow melting apparatus by means of the continuous debris removal mechanism.

25. The method of claim 24, wherein the sparger tube further comprises laterally extending arms.

* * * * *